US009816197B2

(12) United States Patent
Shimoyama et al.

(10) Patent No.: US 9,816,197 B2
(45) Date of Patent: Nov. 14, 2017

(54) SN ALLOY PLATING APPARATUS AND SN ALLOY PLATING METHOD

(71) Applicant: EBARA CORPORATION, Tokyo (JP)

(72) Inventors: Masashi Shimoyama, Tokyo (JP); Yuji Araki, Tokyo (JP); Masamichi Tamura, Tokyo (JP); Toshiki Miyakawa, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 661 days.

(21) Appl. No.: 14/267,874

(22) Filed: May 1, 2014

(65) Prior Publication Data

US 2014/0332393 A1 Nov. 13, 2014

(30) Foreign Application Priority Data

May 9, 2013 (JP) ..... 2013-099722

(51) Int. Cl.
*C25D 3/60* (2006.01)
*C25D 21/18* (2006.01)
(Continued)

(52) U.S. Cl.
CPC ..... *C25D 21/18* (2013.01); *C25D 3/60* (2013.01); *C25D 17/002* (2013.01); *C25D 17/10* (2013.01)

(58) Field of Classification Search
CPC ... C25D 3/30; C25D 3/32; C25D 3/60; C25D 21/14; C25D 21/16; C25D 21/18; B01D 61/44–61/54
See application file for complete search history.

(56) References Cited

U.S. PATENT DOCUMENTS 3,663,384 A * 5/1972 Lescure ..... C25D 3/60 205/252
4,085,010 A * 4/1978 Ishimori ..... C25D 15/02 204/237
(Continued)

FOREIGN PATENT DOCUMENTS

CN 202064023 U * 12/2011 ..... C25D 17/00
JP 05-171499 A 7/1993
(Continued)

OTHER PUBLICATIONS

Miura et al., Machine Translation, JP H5-171499 A (1993).*
(Continued)

*Primary Examiner* — Bryan D. Ripa
*Assistant Examiner* — Ho-Sung Chung
(74) *Attorney, Agent, or Firm* — Baker & Hostetler LLP

(57) ABSTRACT

An Sn alloy plating apparatus is disclosed. The apparatus includes a plating bath configured to store an Sn alloy plating solution therein with an insoluble anode and a substrate immersed in the Sn alloy plating solution, an Sn dissolving having an anion exchange membrane therein which isolates an anode chamber, in which an Sn anode is disposed, and a cathode chamber, in which a cathode is disposed, from each other, a pure water supply structure configured to supply pure water to the anode chamber and the cathode chamber, a methanesulfonic acid solution supply structure configured to supply a methanesulfonic acid solution, containing a methanesulfonic acid, to the anode chamber and the cathode chamber, and an Sn replenisher supply structure configured to supply an Sn replenisher, produced in the anode chamber and containing Sn ions and a methanesulfonic acid, to the plating bath.

11 Claims, 9 Drawing Sheets

(51) Int. Cl.
*C25D 17/00* (2006.01)
*C25D 17/10* (2006.01)

(56) References Cited

U.S. PATENT DOCUMENTS 4,268,124 A * 5/1981 Lui ..... C25D 3/562 359/848
4,450,047 A * 5/1984 Malzahn ..... C07C 303/42 159/48.2
5,100,517 A * 3/1992 Starinshak ..... C25D 21/18 205/138
5,227,046 A * 7/1993 Murphy ..... C25D 3/60 204/DIG. 13
5,618,404 A * 4/1997 Okuhama ..... C25B 3/00 205/445
6,379,520 B1 * 4/2002 Kuriyama ..... C25D 21/14 204/238
6,406,608 B1 * 6/2002 Uzoh ..... C25D 21/14 204/237
6,630,060 B1 * 10/2003 Vaarni ..... C25D 5/08 204/213
2005/0184369 A1 * 8/2005 Sonoda ..... B23K 35/262 257/677
2005/0189231 A1 * 9/2005 Capper ..... C25D 3/565 205/246
2006/0102485 A1 * 5/2006 Nakano ..... C23C 18/1619 205/88
2007/0227632 A1 * 10/2007 Schnetz ..... C25D 7/0614 148/518
2009/0095633 A1 * 4/2009 Inoue ..... B41N 3/032 205/143

FOREIGN PATENT DOCUMENTS

JP 08-035088 A 2/1996
JP H8-71376 * 3/1996 ..... B01D 61/44
JP 11-021692 1/1999
JP 2000-219993 8/2000
JP 2003-105581 4/2003
JP 2004-131767 A 4/2004
JP 2005-126753 A 5/2005
JP 2005-139474 6/2005
JP 2009-149979 A 7/2009

OTHER PUBLICATIONS

Miura et al., Partial Human Translation, JP H5-171499 A (1993).*
Li, Machine Translation, CN 202064023 U (2011).*
Miura & Suda et al., Machine Translation (1996).*

* cited by examiner

SN ALLOY PLATING APPARATUS AND SN ALLOY PLATING METHOD

CROSS REFERENCE TO RELATED APPLICATION

This application claims priority to Japanese Patent Application No. 2013-099722 filed May 9, 2013, the entire contents of which are hereby incorporated by reference.

BACKGROUND

As is known in the art, a film of an alloy of Sn (tin) and a metal which is nobler than Sn (e.g., an Sn—Ag alloy which is an alloy of Sn and silver), formed by electroplating on a substrate surface, can be used for lead-free solder bumps. Sn—Ag alloy plating is typically carried out by applying a voltage between an anode and a substrate surface, which are disposed opposite to each other and immersed in an Sn—Ag alloy plating solution containing Sn ions and Ag ions, thereby forming an Sn—Ag alloy film on the substrate surface. Other than the Sn—Ag alloy, an Sn—Cu alloy which is an alloy of Sn and Cu (copper), an Sn—Bi alloy which is an alloy of Sn and Bi (bismuth), and the like can be used as an alloy of Sn and a metal which is nobler than Sn.

Various Sn alloy plating methods using a soluble anode made of Sn (Sn anode) have been proposed. For example, a plating method has been proposed which involves separating an anode chamber, in which an Sn anode is disposed, from a plating bath by using an anion exchange membrane, and putting an Sn plating solution and an acid or a salt thereof into the anode chamber and putting an Sn alloy plating solution into the plating bath (see Japanese Patent No. 4441725). A plating method has also been proposed which comprises carrying out plating of a plating object in a plating bath by using an Sn anode which is isolated by an anode bag or box formed of a cation exchange membrane (see Japanese Patent No. 3368860).

An Sn alloy plating method using an insoluble anode of titanium or other material has also been proposed (see Japanese laid-open patent publication No. 2003-105581). In this method, a dissolving bath is provided in addition to a plating bath (an electrolytic bath) in which alloy plating is performed. The dissolving bath has an Sn anode, a cathode plate, and a cation exchange membrane disposed therein. Electrolysis is performed to liquate Sn to thereby produce an Sn replenisher containing the liquated Sn, which is then supplied to the Sn alloy plating bath.

Further, an Sn—Ag alloy plating method has been proposed which involves providing an auxiliary cell having a cathode chamber and an anode chamber which are separated by a barrier membrane or a diaphragm so that a substance that can cause deterioration of a plating solution will not diffuse into the cathode chamber, and supplying Sn ions to the plating solution (anolyte) in the cathode chamber in the auxiliary bath (see Japanese laid-open patent publication No. H11-21692).

When performing the Sn—Ag alloy plating which is an example of the Sn alloy plating, an Sn—Ag alloy plating solution is used. This plating solution contains a salt (e.g., tin methanesulfonate) formed from the reaction of Sn ion ($Sn^{2+}$) and an acid capable of forming a water-soluble salt with Sn ion ($Sn^{2+}$), and a salt (e.g., silver methanesulfonate) formed from the reaction of Ag ion ($Ag^{+}$) and an acid capable of forming a water-soluble salt with Ag ion ($Ag^{+}$).

When the Sn alloy plating is performed with use of an soluble anode (Sn anode), the Sn ion that has been liquated from the Sn anode into the Sn alloy plating solution can cause a change (or an increase) in a concentration of Sn ion in the Sn alloy plating solution, as the plating progresses. As a result, it becomes difficult to maintain a predetermined concentration of the Sn ion in the Sn alloy plating solution.

In the case where a metallic element for forming an alloy with Sn is Ag which is a metal nobler than Sn, use of the soluble Sn anode in the Sn alloy plating may cause a substitution reaction of Ag with Sn on the surface of the Sn anode, thus causing deposition and falling of metal particles. Since Ag ion is consumed in the substitution reaction, the concentration of Ag ion in the plating solution is lowered. In the above-described Japanese Patent No. 4441725, in order to prevent the substitution reaction of Ag ion on the surface of the Sn anode, the anode chamber, in which the Sn anode is disposed, is partitioned by the anion exchange membrane, and an anolyte is supplied into the plating bath (Into the cathode side thereof) to thereby replenish Sn ion. However, since the cathode side has a limit to its volume, it is necessary to discharge a catholyte with an amount equal to the amount of the anolyte supplied from the anode chamber. As a result, Sn ion contained in the discharged catholyte is discarded. In order to replenish the shortage of Sn ion, it is necessary to supply the tin methanesulfonate solution, which increases costs.

When an Sn—Ag alloy plating is performed using the insoluble anode of titanium or other material, metal ions (Sn ion and Ag ion) and free acid (e.g., methanesulfonic acid) are separated from each other as the Sn—Ag plating process progresses. The metal ions are consumed by the plating process, and a concentration of the acid in the Sn—Ag alloy plating solution gradually increases. Thus, it is preferable to replenish the shortage of the metal ions that have been consumed in the Sn—Ag alloy plating and to adjust the concentration of the acid in the plating solution within a desirable range in order to maintain good appearance of a film formed by the plating process and to maintain good uniformity of film thickness. Sn ion, which acts effectively on the plating process, is typically divalent ion, which is, however, liable to change into tetravalent ion as a result of oxidation by oxygen. The resultant tetravalent Sn ion is likely to form colloid and particles, which sink or are caught by a filter and do not contribute to the plating process.

SUMMARY OF THE INVENTION

It is therefore an object to provide an Sn alloy plating apparatus and an Sn alloy plating method capable of easily adjusting a concentration of Sn ion in a plating solution.

Embodiments, which will be described below, relate to an Sn alloy plating apparatus and Sn alloy plating method useful for forming a film of an alloy of Sn and a metal which is nobler than Sn (e.g., a lead-free Sn—Ag alloy having good soldering properties) on a substrate surface.

In an embodiment, an Sn alloy plating apparatus for plating a surface of a substrate with an alloy of Sn and a metal nobler than Sn is provides. The Sn alloy plating apparatus includes: a plating bath configured to store an Sn alloy plating solution therein with an Insoluble anode and a substrate disposed opposite to each other in the Sn alloy plating solution; an Sn dissolving bath having an Sn anode and a cathode arranged opposite to each other in an electrolyte, the Sn dissolving bath having an anion exchange membrane therein which isolates an anode chamber, in which the Sn anode is disposed, and a cathode chamber, in which the cathode is disposed, from each other; a pure water supply structure configured to supply pure water to the anode chamber and the cathode chamber, a methanesulfonic acid solution supply structure configured to supply a methanesulfonic acid solution, containing a methanesulfonic acid for stabilizing Sn ions, to the anode chamber and the cathode chamber, and an Sn replenisher supply structure configured to supply an Sn replenisher, produced in the anode chamber and containing Sn ions and a methanesulfonic acid, to the plating bath.

In an embodiment, the Sn alloy plating apparatus further includes a gas supply structure configured to supply an inert gas into the Sn replenisher produced in the anode chamber.

In an embodiment, the Sn alloy plating apparatus further includes an electrolyte dialysis bath configured to remove the methanesulfonic acid from the Sn alloy plating solution.

In an embodiment, the Sn alloy plating apparatus further includes: an electric dialysis bath configured to electrolyze the plating solution to produce a methanesulfonic acid replenisher containing a methanesulfonic acid; and a delivery pipe configured to deliver the methanesulfonic acid replenisher to the Sn dissolving bath.

In an embodiment, the Sn alloy plating apparatus further includes a plating solution reservoir configured to store the plating solution discharged from the plating bath.

In an embodiment, the Sn alloy plating apparatus further includes a plating solution delivery structure configured to supply the plating solution stored in the plating solution reservoir to the anode chamber.

In an embodiment, the Sn alloy plating apparatus further includes an anode bag surrounding the Sn anode. The anode bag may be formed of PP (polypropylene), PVC (polyvinyl chloride), PVDF (polyvinylidene difluoride), PFA (perfluoro alkoxy alkane), or PTFE (polytetrafluoroethylene).

In an embodiment, the anion exchange membrane comprises at least two superposed anion exchange membranes.

In an embodiment, the Sn alloy plating apparatus further includes a microporous membrane having micropores which is disposed between the anion exchange membrane and the cathode.

In an embodiment, the cathode is made of platinum, titanium, zirconium, or titanium or tin covered with platinum.

In an embodiment, the Sn replenisher supply structure includes an Sn replenisher reservoir configured to store the Sn replenisher produced in the anode chamber.

In an embodiment, the Sn alloy plating apparatus further includes: an Sn ion concentration analyzer configured to measure a concentration of Sn ions in the electrolyte in the anode chamber, a methanesulfonic acid concentration analyzer configured to measure a concentration of a methanesulfonic acid in the electrolyte in the anode chamber; and a controller configured to control the concentration of Sn ions and the concentration of the methanesulfonic acid in the electrolyte in the anode chamber, wherein the controller is configured to regulate amounts of the pure water and the methanesulfonic acid solution which are supplied respectively from the pure water supply structure and the methanesulfonic acid solution supply structure to the Sn dissolving bath, based on measurement values of the concentration of the Sn ions and the concentration of the methanesulfonic acid.

In an embodiment, the Sn alloy plating apparatus further includes a controller having a calculating function to calculate a concentration of the Sn ions and a concentration of the methanesulfonic acid in the electrolyte based on an amount of the methanesulfonic acid solution supplied, an amount of the pure water supplied, and an amount of electrolysis performed in the electrolyte in the Sn dissolving bath, wherein the controller is configured to regulate the amounts of the pure water and the methanesulfonic acid solution which are supplied respectively from the pure water supply structure and the methanesulfonic acid solution supply structure to the Sn dissolving bath, based on the concentration of the Sn ions and the concentration of the methanesulfonic acid.

In an embodiment, an Sn alloy plating method of plating a surface of a substrate with an alloy of Sn and a metal nobler than Sn is provided. The method includes: immersing an insoluble anode and a substrate, which are opposite to each other, in an Sn alloy plating solution; applying a voltage between the insoluble anode and the substrate; applying a voltage between an Sn anode and a cathode which are disposed respectively in an anode chamber and a cathode chamber isolated from each other by an anion exchange membrane, with an electrolyte stored in the anode chamber and the cathode chamber, thereby producing an Sn replenisher containing Sn ions and a methanesulfonic acid in the anode chamber; supplying the Sn replenisher to the Sn alloy plating solution; supplying pure water to the anode chamber and the cathode chamber; and supplying a methanesulfonic acid solution containing a methanesulfonic acid for stabilizing Sn ions to the anode chamber and the cathode chamber.

In an embodiment, the concentration of Sn ions in the electrolyte in the anode chamber ranges from 200 g/L to 350 g/L.

In an embodiment, a concentration of a methanesulfonic acid as a free acid in the electrolyte in the anode chamber ranges from 40 g/L to 200 g/L.

In an embodiment, a concentration of a methanesulfonic acid in the electrolyte in the cathode chamber ranges from 300 g/L to 500 g/L.

In an embodiment, a current density of the Sn anode ranges from 2.0 $A/dm^2$ to 6.0 $A/dm^2$.

In an embodiment, the Sn alloy plating method further includes adding an oxidation inhibitor to the electrolyte in the anode chamber. The oxidation inhibitor may comprise dihydroxynaphthalene, hydroxyquinoline, or sulfonate of a dihydroxy aromatic compound.

According to the above-described embodiments, the Sn replenisher (or Sn replenishment liquid) is produced in the Sn dissolving bath and is supplied to the plating bath by the Sn replenisher supplying structure, thus adjusting the concentration of Sn ion in the plating solution used in plating of the substrate. Further, the pure water supply structure and the methanesulfonic acid solution supply structure can adjust the concentration of the methanesulfonic acid (MSA) contained in the electrolyte in the Sn dissolving bath. Therefore, the Sn dissolving bath can supply the plating bath with the Sn replenisher containing the methanesulfonic acid in an optimal amount for stabilizing the Sn ion.

DETAILED DESCRIPTION OF EMBODIMENTS

Figure 1:
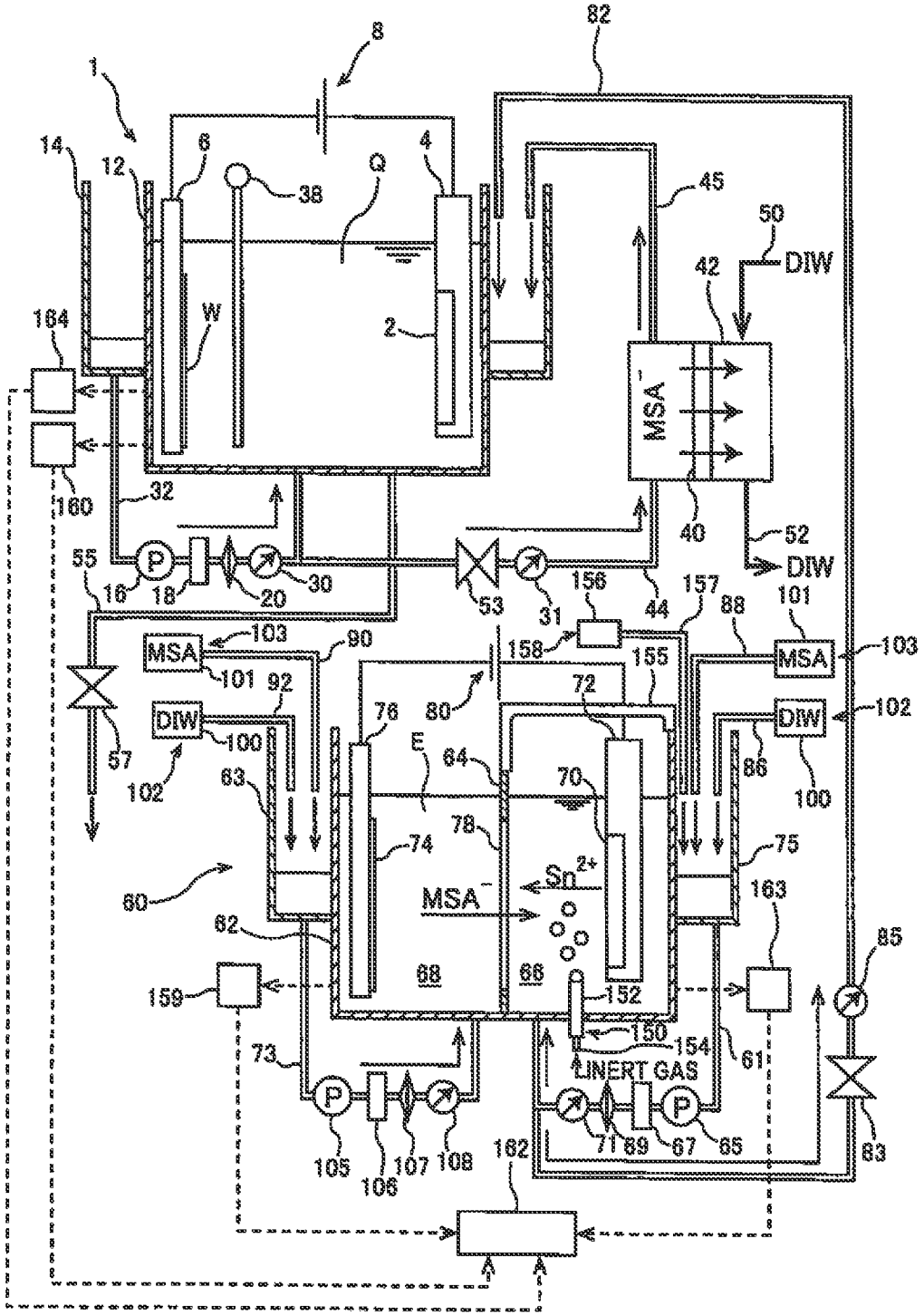
FIG. 1 is a schematic view showing an Sn alloy plating apparatus according to an embodiment.
Figure 2:
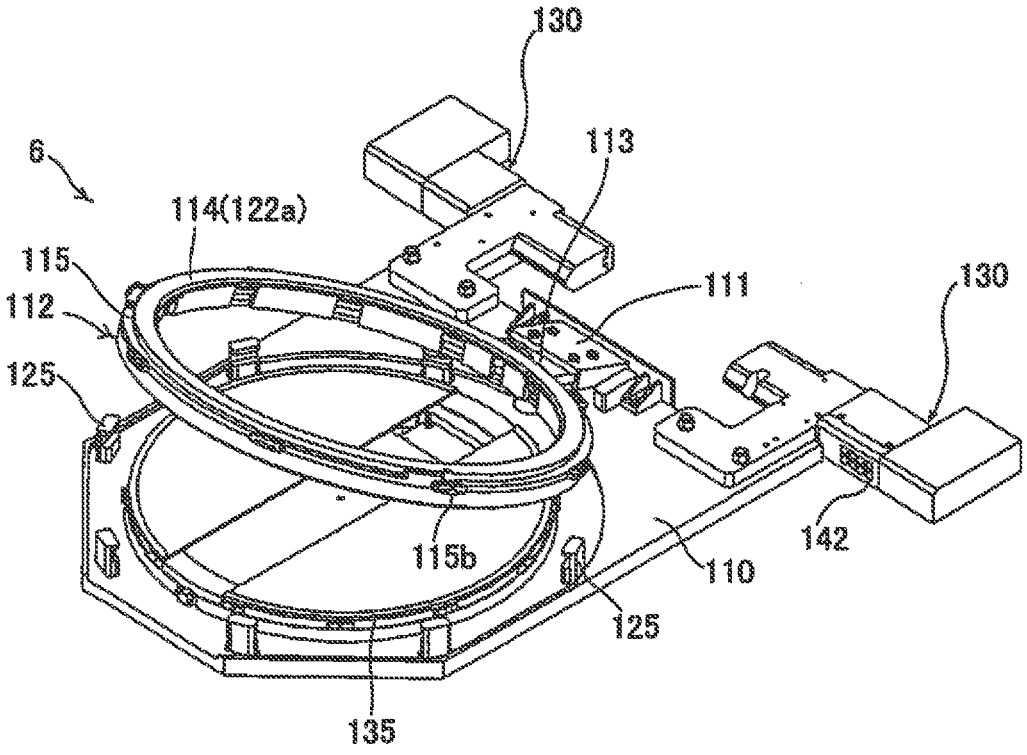
FIG. 2 is a perspective view showing a substrate holder.

Embodiments will now be described in detail with reference to the drawings. The same reference numerals are used in the figures and descriptions to refer to the same or like members, components, etc., and duplicate descriptions thereof are omitted in FIGS. 1 through 9. The following embodiment illustrates an exemplary case where Ag (silver) is used as a metal which is nobler than Sn (tin) and a film of an Sn—Ag alloy is formed on a substrate surface by a plating process. Methanesulfonic acid (MSA) is used as an acid that stabilizes Sn ions (and Ag ions). Thus, an Sn—Ag alloy plating solution is used which contains tin methanesulfonate as a source of Sn ions ($Sn^{2+}$) and silver methanesulfonate as a source of Ag ions ($Ag^{+}$).

FIG. 1 is a schematic view showing an Sn alloy plating apparatus according to an embodiment. As shown in FIG. 1, the Sn alloy plating apparatus includes a plating bath 1 that holds an Sn alloy plating solution (which will be hereinafter simply referred to as "plating solution") Q therein and an anode holder 4 that holds an insoluble anode 2 made of titanium, for example, and immerses the insoluble anode 2 in the plating solution Q held in the plating bath 1. The Sn alloy plating apparatus further includes a substrate holder 6 that detachably holds a substrate W and immerses the substrate W in the plating solution Q held in the plating bath 1. The insoluble anode 2 and the substrate W are disposed opposite to each other in the plating solution Q.

When performing a plating process, the insoluble anode 2 is connected to a positive electrode of a power supply 8 through the anode holder 4, while a conductive layer (not shown), such as a seed layer, formed on the surface of the substrate W is connected to a negative electrode of the power supply 8 through the substrate holder 6. A voltage is applied between the insoluble anode 2 and the surface of the substrate W, so that a film of Sn—Ag alloy is formed on the surface of the conductive layer. This film may be used as lead-free solder bumps.

The plating bath 1 has an inner bath 12 that stores the plating solution Q therein and an overflow bath 14 disposed around the inner bath 12. The plating solution Q overflows an upper end of the inner bath 12 into the overflow bath 14. One end of a plating solution circulation line 32 for circulating the plating solution Q is coupled to a bottom of the overflow bath 14, and the other end of the plating solution circulation line 32 is coupled to a bottom of the inner bath 12. The plating solution circulation line 32 is provided with a pump 16 for delivering the plating solution Q, a beat exchanger (or a temperature regulator) 18 for regulating the temperature of the plating solution Q, a filter 20 for removing foreign matter in the plating solution Q, and a flow meter 30 for measuring a flow rate of the plating solution Q.

The plating solution Q that has flowed into the overflow bath 14 is returned to the inner bath 12 through the plating solution circulation line 32. At this time, deposited materials contained in the plating solution Q are removed by the filter 20. Therefore, the plating solution Q is always kept clean.

An agitating paddle 38 as an agitator for agitating the plating solution Q is disposed adjacent to the surface of the substrate W held by the substrate holder 6 in the inner bath 12. The agitating paddle 38, which extends vertically, reciprocates parallel to the substrate W to thereby agitate the plating solution Q. The agitating peddle 38 agitates the plating solution Q during plating of the substrate W, so that a sufficient amount of metal ions can be supplied uniformly to the surface of the substrate W.

A first plating solution supply line 44 for delivering a part of the plating solution Q, flowing through the plating solution circulation line 32, to an electrolyte dialysis bath 42 is connected to the plating solution circulation line 32. The electrolyte dialysis bath 42 has an anion exchange membrane 40 disposed therein. The first plating solution supply line 44 extends from a downstream side of the flow meter 30 to the electrolyte dialysis bath 42. One end of a second plating solution supply line 45 for delivering the plating solution Q to the overflow bath 14 is connected to the electrolyte dialysis bath 42, and the other end of the second plating solution supply line 45 is connected to the overflow bath 14.

A liquid supply line 50 for supplying pure water (DIW) into the electrolyte dialysis bath 42 is connected to the electrolyte dialysis bath 42. A liquid discharge line 52 for discharging the pure water that has been supplied to the electrolyte dialysis bath 42 out of the electrolyte dialysis bath 42 is also connected to the electrolyte dialysis bath 42. A part of the plating solution Q in the overflow bath 14 is delivered through the plating solution circulation line 32 and the first plating solution supply line 44 to the electrolyte dialysis bath 42. In the electrolyte dialysis bath 42, a methanesulfonic acid (MSA) as a free acid separated from tin methanesulfonate and silver methanesulfonate, and a methanesulfonic acid (MSA) as an acid for stabilizing Sn ions, which is supplied together with Sn ions to the plating solution Q, are removed from the plating solution Q by a diffusion dialysis performed using the anion exchange membrane 40. Thereafter, the plating solution Q is returned through the second plating solution supply line 45 to the overflow bath 14. The methanesulfonic acid that has been removed from the plating solution Q by the dialysis is diffused into the pure water supplied from the liquid supply line 50 into the electrolyte dialysis bath 42, and then discharged together with the pure water from the electrolyte dialysis bath 42 through the liquid discharge line 52. The plating solution Q that has been returned to the overflow bath 14 is returned to the inner bath 12 through the plating solution circulation line 32 and is used in plating of the substrate W again.

DSV (effective membrane area: 0.0172 $m^2$) manufactured by AGC engineering Co., Ltd., may be used as the anion exchange membrane 40. Depending on the amount of dialysis on the plating solution Q, i.e., the amount of methanesulfonic acid to be removed, a desired number of (e.g., 19) anion exchange membranes 40 are assembled in the dialysis bath 42.

An on-off valve 53 and a flow meter 31 are attached to the first plating solution supply line 44. When the on-off valve 53 is opened, a part of the plating solution Q is delivered to the electrolyte dialysis bath 42. A liquid drain pipe 55 is connected to the bottom of the inner bath 12. When an on-off valve 57, which is attached to the liquid drain pipe 55, is opened, the plating solution Q is discharged from the inner bath 12 to the exterior of the inner bath 12.

The Sn alloy plating apparatus has an Sn dissolving device 60 for replenishing the plating bath 1 with an Sn replenisher (or Sn replenishment liquid), which contains Sn ions and the methanesulfonic acid for stabilizing the Sn ions. The Sn dissolving device 60 has an Sn dissolving bath 62 that stores an electrolyte E therein. An interior space in the Sn dissolving bath 62 is divided into an anode chamber 66 and a cathode chamber 68 by a partition wall 64 having an anion exchange membrane 78, which isolates the anode chamber 66 and the cathode chamber 68 from each other. The Sn alloy plating apparatus further includes an anode-side overflow bath 75 disposed adjacent to the anode chamber 66 and a cathode-side overflow bath 63 disposed adjacent to the cathode chamber 68. The electrolyte E in the cathode chamber 68 overflows into the cathode-side overflow bath 63, while the electrolyte E in the anode chamber 66 overflows into the anode-side overflow bath 75.

The anode chamber 66 houses a soluble Sn anode 70 therein, which is made of Sn and held by an anode holder 72. In this embodiment, the electrolyte E in the anode chamber 66 does not contain Ag ions, and hence Ag is not deposited by way of a substitution on the surface of the Sn anode 70. The cathode chamber 68 houses therein a cathode 74 that is held by a cathode holder 76. The cathode 74 is preferably made of highly corrosion-resistant Pt (platinum), Ti (titanium), Zr (zirconium), or Ti covered with Pt, or more preferably made of Sn. If the cathode 74 is made of Sn, it can effectively utilize Sn ions which may have leaked from the anode chamber 66 into the cathode chamber 68. More specifically, Sn ions, which have leaked into the cathode chamber 68, are deposited as Sn on the surface of the cathode 74, and the cathode 74 whose surface is covered with Sn is used as an Sn anode in another Sn dissolving bath.

The Sn anode 70 and the cathode 74 are disposed so as to face each other and are immersed in the electrolyte E in the Sn dissolving bath 62. The Sn anode 70 is connected to a positive electrode of a power supply 80 through the anode holder 72, and the cathode 74 is connected to a negative electrode of the power supply 80 though the cathode holder 76, so that the Sn dissolving bath 62 performs an electrolysis. As a result of the electrolysis, a highly concentrated Sn replenisher (or Sn replenishment liquid) is produced in the Sn dissolving bath 62. AAV (manufactured AGC engineering Co., Ltd.), for example, is used as the anion exchange membrane 78. During the electrolysis, the Sn anode 70 has a current density in the range of 2.0 $A/dm^2$ to 6.0 $A/dm^2$, and more preferably a current density in the range of 2.4 $A/dm^2$ to 3.8 $A/dm^2$. If the current density of the Sn anode 70 is too low, it takes a longer time to produce a high-concentration Sn replenisher. Conversely, if the current density of the Sn anode 70 is too high, Sn ions become less liable to be dissolved into the electrolyte E.

One end of an electrolyte circulation line 61 for circulating the electrolyte E in the anode chamber 66 is connected to a bottom of the anode-side overflow bath 75. The other end of the electrolyte circulation line 61 is connected to the bottom of the anode chamber 66. The electrolyte circulation line 61 is provided with a pump 65 for delivering the electrolyte E, a heat exchanger (temperature regulator) 67 for regulating the temperature of the electrolyte E, a filter 69 for removing foreign matter from the electrolyte E, and a flow meter 71 for measuring a flow rate of the electrolyte E. The heat exchanger 67 may be omitted. The electrolyte E that has flowed into the anode-side overflow bath 75 is returned to the anode chamber 66 through the electrolyte circulation line 61.

The Sn dissolving device 60 further has a gas supply structure 150 for supplying the anode chamber 66 with an inert gas, such as an $N_2$ gas or the like, to agitate the electrolyte E in the anode chamber 66. The gas supply structure 150 includes a bubbling device 152 having injection pots defined in its upper surface and disposed on the bottom of the anode chamber 66, and a gas supply line 154 coupled to the bubbling device 152. An inert gas, which is supplied from a gas supply source, not shown, is introduced through the gas supply line 154 and the bubbling device 152 into the anode chamber 66, forming bubbles in the anode chamber 66 to thereby agitate the electrolyte E in the anode chamber 66. The inert gas also has a function to prevent oxidation of Sn ions generated by the electrolysis. The inert gas preferably comprises a nitrogen gas.

The bubbling device 152 may preferably be combined with a cover 155 over the anode chamber 66 so as to cover the anode chamber 66. The inert gas that has been supplied from the bubbling device 152 covers the surface of the electrolyte E in the anode chamber 66, thereby preventing the oxidation of Sn ions more reliably.

One end of an electrolyte circulation line 73 for circulating the electrolyte E in the cathode chamber 68 is connected to a bottom of the cathode-side overflow both 63. The other end of the electrolyte circulation line 73 is connected to the bottom of the cathode chamber 68. The electrolyte circulation line 73 is provided with a pump 105 for delivering the electrolyte B, a heat exchanger (temperature regulator) 106 for regulating the temperature of the electrolyte E, a filter 107 for removing foreign matter from the electrolyte E, and a flow meter 108 for measuring a flow rate of the electrolyte E. The heat exchanger 106 may be omitted. The electrolyte E that has flowed into the cathode-side overflow bath 63 is returned to the cathode chamber 68 through the electrolyte circulation line 73.

The Sn dissolving device 60 has a first pure water supply line 86 for supplying pure water into the anode chamber 66 through the anode-side overflow bath 75, and a first methanesulfonic acid solution supply line 88 for supplying a methanesulfonic acid solution into the anode chamber 66 through the anode-side overflow bath 75. The Sn dissolving device 60 further has a second methanesulfonic acid solution supply line 90 for supplying a methanesulfonic acid solution to the cathode chamber 68 through the cathode-side overflow bath 63, and a second pure water supply line 92 for supplying pure water into the cathode chamber 68 through the cathode-side overflow bath 63. The pure water supply lines 86, 92 are coupled to a pure water supply tank 100. The pure water supply lines 86, 92 and the pure water supply tank 100 jointly constitute a pure water supply structure 102 for supplying pure water to the anode chamber 66 and the cathode chamber 68. The methanesulfonic acid solution supply lines 88, 90 are coupled to a methanesulfonic acid solution supply tank 101. The methanesulfonic acid solution supply lines 88, 90 and the methanesulfonic acid solution supply tank 101 jointly constitute a methanesulfonic acid solution supply structure 103 for supplying a methanesulfonic acid solution to the anode chamber 66 and the cathode chamber 68. The electrolyte E contains a methanesulfonic acid (MSA) for stabilizing Sn ions. During the electrolysis with use of this electrolyte E, only the methanesulfonic acid is permitted to pass through the anion exchange membrane 78. The methanesulfonic acid solution and the pure water are mixed with each other to produce an electrolyte E having a predetermined concentration in the Sn dissolving bath 62.

Sn ion, which acts effectively on the plating process, is typically divalent ion, which is, however, liable to change into tetravalent ion as a result of oxidation by oxygen. The resultant tetravalent Sn ion is likely to form colloid and particles, which sink or arc caught by a filter and do not contribute to the plating process. In order to prevent this, an oxidation inhibitor for preventing oxidation of Sn ions is added to the electrolyte E in the anode chamber 66 of the Sn dissolving bath 62. The oxidation inhibitor may comprise dihydroxynaphthalene, hydroxyquinoline, or sulfonate of a dihydroxy aromatic compound. The Sn dissolving device 60 has an oxidation inhibitor supply structure 158 for supplying the oxidation inhibitor to the anode-side overflow bath 75. This oxidation inhibitor supply structure 158 includes an oxidation inhibitor supply tank 156 and an oxidation inhibitor supply line 157.

One end of an Sn replenisher supply line 82 for supplying the plating bath 1 with the Sn replenisher that contains the methanesulfonic acid and Sn ions is connected to the electrolyte circulation line 61, and the other end is connected to the overflow bath 14. The Sn replenisher supply line 82 extends from a downstream side of the flow meter 71 to the overflow bath 14. The Sn replenisher is supplied through the Sn replenisher supply line 82 into the overflow bath 14, and then delivered through the plating solution circulation line 32 to the inner bath 12. An on-off valve 83 and a flow meter 85 are attached to the Sn replenisher supply line 82. When the on-off valve 83 is opened, the Sn replenisher is delivered to the overflow bath 14. The pump 65, the Sn replenisher supply line 82, and the on-off valve 83 jointly constitute an Sn replenisher supply structure for supplying the Sn replenisher, produced in the Sn dissolving bath 62, to the plating both 1.

The electrolyte E in the anode chamber 66 and the electrolyte E in the cathode chamber 68 are separately prepared and supplied because they have different concentrations of the methanesulfonic acid as a desirable free acid. The electrolyte E in the anode chamber 66 may be prepared by feeding a solution, which contains highly concentrated Sn ions and a methanesulfonic acid as a free acid, into the anode chamber 66 before the operation of the Sn dissolving device 60 is started.

The electrolysis is carried out with the anode chamber 66 and the cathode chamber 68 filled with the respective electrolytes E. During the electrolysis, Sn ions are liquated from the Sn anode 70 into the electrolyte E in the anode chamber 66. Simultaneously, the methanesulfonic acid contained in the electrolyte E in the cathode chamber 68 passes through the anion exchange membrane 78 into the anode chamber 66. In this manner, the Sn ions and the methanesulfonic acid are supplied to the electrolyte E in the anode chamber 66. The electrolyte E in the anode chamber 66, to which the Sn ions have been supplied, flows through the Sn replenisher supply line 82 and is supplied as the highly-concentrated Sn replenisher into the overflow bath 14 of the plating bath 1. The concentration of the methanesulfonic acid as a free acid in the electrolyte E stored in the anode chamber 66 is preferably in the range of 40 g/L to 200 g/L and more preferably in the range of 40 g/L to 150 g/L at the time the electrolyte E is to be supplied into the overflow bath 14 of the plating bath 1. If the concentration of the methanesulfonic acid contained as a free acid in the plating solution Q in the inner bath 12 of the plating bath 1 is too high, a quality of a film formed on the surface of the substrate W by the plating process is lowered and the concentration of Ag in the plating film is lowered. Therefore, it is not desirable that the concentration of the methanesulfonic acid as a free acid in the electrolyte E in the anode chamber 66 is too high. Conversely, if the concentration of the methanesulfonic acid as a free acid in the electrolyte E in the anode chamber 66 is too low, the Sn ions in the electrolyte E become unstable.

When a voltage is applied between the Sn anode 70 and the cathode 74 to perform an electrolysis, the methanesulfonic acid contained in the electrolyte E in the cathode chamber 68 passes through the anion exchange membrane 78 into the anode chamber 66, so that the concentration of the methanesulfonic acid is gradually reduced. When the concentration of the methanesulfonic acid contained in the electrolytes E in the cathode chamber 68 drops, a methanesulfonic acid solution is supplied through the second methanesulfonic acid solution supply line 90 and the electrolyte circulation line 73 into the cathode chamber 68. In this manner, the concentration of the methanesulfonic acid contained in the electrolytes E in the cathode chamber 68 is adjusted. The concentration of the methanesulfonic acid in the electrolytes E in the cathode chamber 68 may preferably be in the range of 300 g/L to 500 g/L. In order to compensate for a shortage of pure water due to evaporation, pure water may be supplied from the pure water supply lines 86, 92 into the anode chamber 66 and the cathode chamber 68. Furthermore, the supply of the pure water to the anode chamber 66 and the cathode chamber 68 is also able to adjust the concentration of the methanesulfonic acid in the electrolytes E.

The concentration of the methanesulfonic acid in the electrolytes E in the cathode chamber 68 is adjusted within the range of 300 g/L to 500 g/L because the methanesulfonic acid in the electrolytes E in the cathode chamber 68 serves as a source of the methanesulfonic acid moving from the cathode chamber 68 into the anode chamber 66 so as not to lower the concentration of the methanesulfonic acid in the anode chamber 66 and because it is necessary to prevent the methanesulfonic acid from being diffused from the cathode chamber 68 into the anode chamber 66 in case the concentration of the methanesulfonic acid in the cathode chamber 68 is extremely low.

Next, the substrate holder 6 for holding the substrate W will be described. As shown in FIGS. 2 through 5, the substrate holder 6 includes a first holding member (or a base holding member) 110 having a rectangular plate shape and a second holding member (or a movable holding member) 112 rotatably coupled to the first holding member 110 through a hinge 111 which allows the second holding member 112 to open and close with respect to the first holding member 110. While the second holding member 112 is configured to be openable and closable through the hinge 111 in this embodiment, it is also possible to dispose the second holding member 112 opposite to the first holding member 110 and to move the second holding member 112 away from and toward the first holding member 110 to thereby open and close the second holding member 112.

The first holding member 110 may be made of vinyl chloride. The second holding member 112 includes a base portion 113 and a ring-shaped seal holder 114. The seal holder 114 may be made of vinyl chloride so as to enable a retaining ring 115, which will be described later, to slide well. An annular substrate-side sealing member 120 (see FIG. 4 and FIG. 5), which is projecting inwardly, is attached to an upper portion of the seal holder 114. This substrate-side sealing member 120 is placed in pressure contact with a periphery of the surface of the substrate W to seal a gap between the substrate W and the second holding member 112 when the substrate W is held by the substrate holder 6. An annular holder-side sealing member 121 (see FIG. 4 and FIG. 5) is attached to a surface, facing the first holding member 110, of the seal holder 114. This holder-side sealing member 121 is placed in pressure contact with the first holding member 110 to seal a gap between the first holding member 110 and the second holding member 112 when the substrate W is held by the substrate holder 6. The holder-side sealing member 121 is located at the outer side of the substrate-side sealing member 120.

Figure 5:
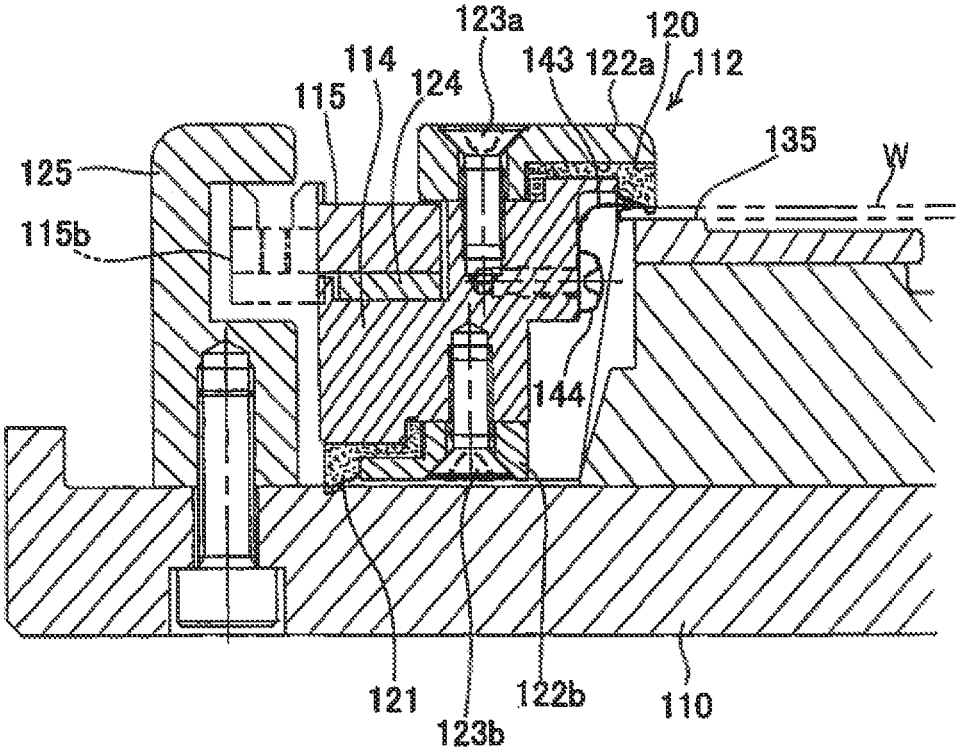
FIG. 5 is an enlarged view showing a portion surrounded by symbol V shown in FIG. 4.

As shown in FIG. 5, the substrate-side sealing member 120 is sandwiched between the seal holder 114 and a first mounting ring 122*a*, which is secured to the seal holder 114 by fastening tools 123*a*, such as screws. The holder-side sealing member 121 is sandwiched between the seal holder 114 and a second mounting ring 122*b*, which is secured to the seal holder 114 by fastening tools 123*b*, such as screws.

The seal holder 114 has a stepped portion at a periphery thereof, and the retaining ring 115 is rotatably mounted to the stepped portion through a spacer 124. The retaining ring 115 is inescapably held by an outer peripheral portion of the first mounting ring 122*a*. This retaining ring 115 is made of a material (e.g., titanium) having high rigidity and excellent acid and alkali corrosion resistance and the spacer 124 is made of a material having a low friction coefficient, for example PTFE, so that the retaining ring 115 can rotate smoothly.

Inverted L-shaped clampers 125, each having an inwardly projecting portion and located at the outer side of the retaining ring 115, are secured to the first holding member 110 at equal intervals along a circumferential direction of the retaining ring 115. The retaining ring 115 has, on its outer circumferential surface, outwardly projecting portions 115*b* arranged at positions corresponding to positions of the clampers 125. A lower surface of the inwardly projecting portion of each clamper 125 and an upper surface of each projecting portion 115*b* of the retaining ring 115 are inclined in opposite directions along the rotational direction of the retaining ring 115 to form tapered surfaces. A plurality (e.g., three) of upwardly projecting protrusions 115*a* are provided on the retaining ring 115 at predetermined positions along the circumferential direction of the retaining ring 115. The retaining ring 115 can be rotated by pushing and moving each protrusion 115*a* in a lateral direction by means of a rotating pin (not shown).

With the second holding member 112 open, the substrate W is inserted into the central portion of the first holding member 110, and the second holding member 112 is then closed through the hinge 111. Subsequently the retaining ring 115 is rotated clockwise so that each projecting portion 115*b* of the retaining ring 115 slides into the inwardly projecting portion of each clamper 125. As a result, the first holding member 110 and the second holding member 112 are fastened to each other and locked by engagement between the tapered surfaces of the retaining ring 115 and the tapered surfaces of the clampers 125. The lock of the second holding member 112 can be released by rotating the retaining ring 115 counterclockwise to disengage the projecting portions 115*b* of the retaining ring 115 from the inverted L-shaped clampers 125.

When the second holding member 112 is locked in the above-described manner, the downwardly-protruding portion of the substrate-side sealing member 120 is placed in pressure contact with the periphery of the surface of the substrate W. The substrate-side sealing member 120 is pressed uniformly against the substrate W to thereby seal the gap between the periphery of the surface of the substrate W and the second holding member 112. Similarly, when the second holding member 112 is locked, the downwardly-protruding portion of the holder-side sealing member 121 is placed in pressure contact with the surface of the first holding member 110. The sealing holder-side sealing member 121 is uniformly pressed against the first holding member 110 to thereby seal the gap between the first holding member 110 and the second holding member 112.

A pair of T-shaped holder hangers 130 are provided on an end portion of the first holding member 110. A protruding portion 134 is formed on the upper surface of the first holding member 110 so as to protrude in a ring shape with a size corresponding to a size of the substrate W. The protruding portion 134 has an annular support surface 135 which contacts a peripheral portion of the substrate W to support the substrate W. The protruding portion 134 has recesses 140 arranged at predetermined positions along a circumferential direction of the protruding portion 134.

Figure 3:
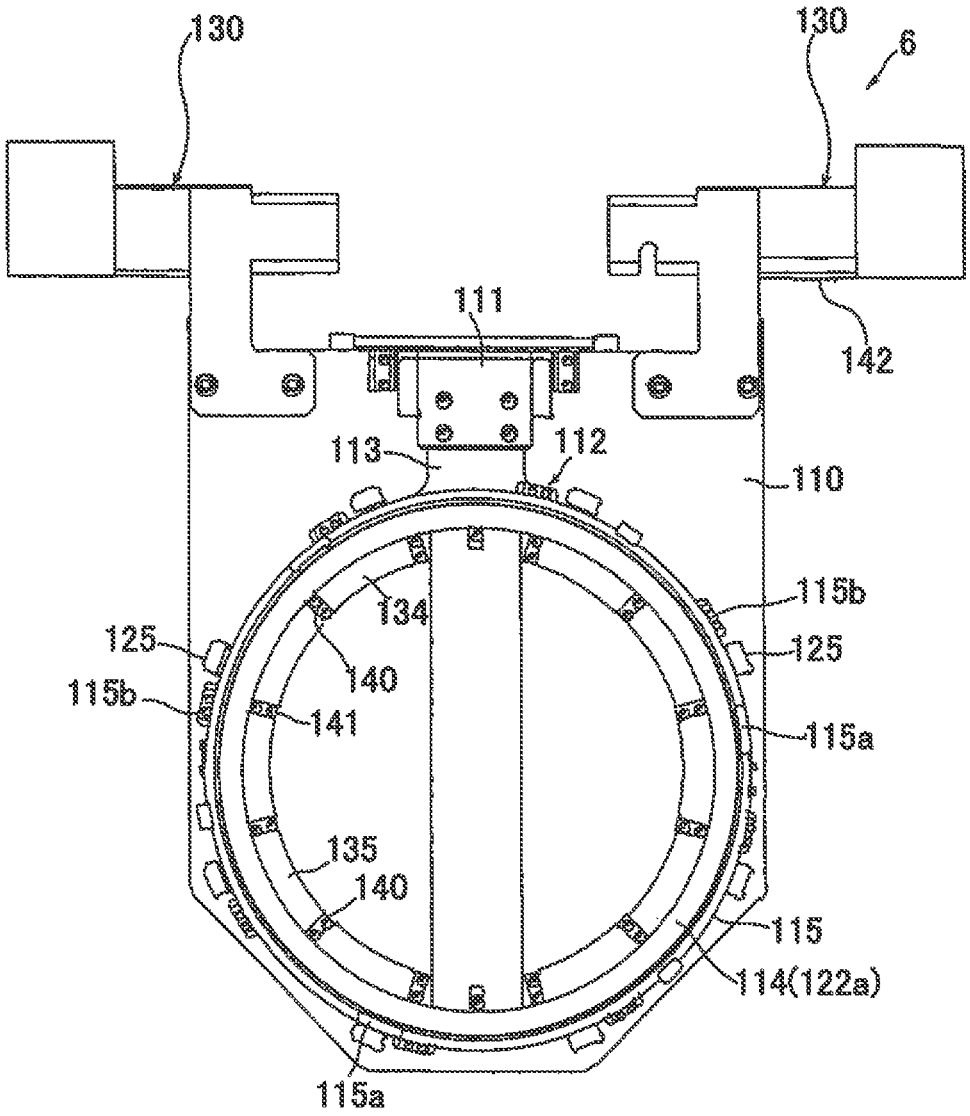
FIG. 3 is a plan view of the substrate holder shown in FIG. 2.
Figure 4:
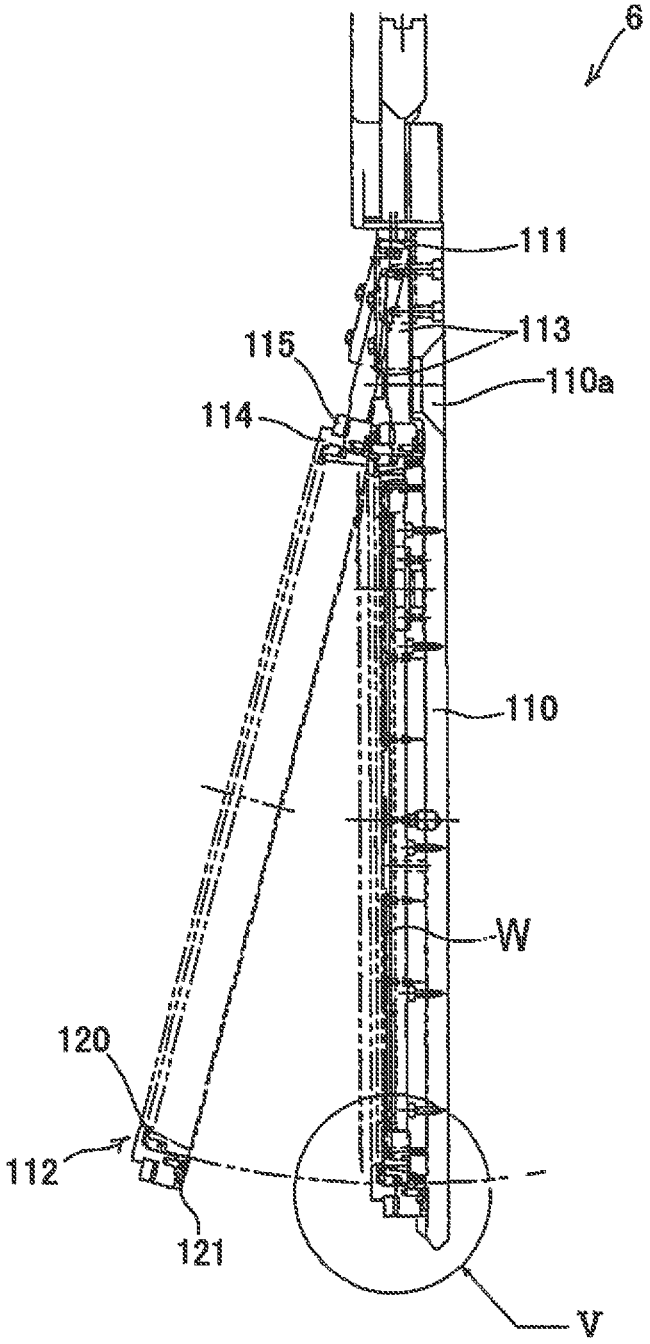
FIG. 4 is a right side view of the substrate holder shown in FIG. 2.

As shown in FIG. 3, a plurality of (e.g., 12 as illustrated) electrical conductors (electrical contacts) 141 are disposed in the recesses 140, respectively. These electrical conductors 141 are coupled respectively to wires extending from connect terminals 142 provided on the holder hanger 130. When the substrate W is placed on the support surface 135 of the first holding member 110, end portions of the electrical conductors 141 spring out around the substrate W to resiliently contact lower portions of electrical contacts 143 shown in FIG. 5.

The electrical contacts 143, which are to be electrically connected to the electrical conductors 141, are secured to the seal holder 114 of the second holding member 112 by fastening tools 144, such as screws. Each of the electrical contacts 143 has a leaf spring-like contact portion located at the outer side of the substrate-side sealing member 120 and projecting inwardly. This spring-like contact portion is springy and bends easily. When the substrate W is held by the first holding member 110 and the second holding member 112, the contact portions of the electrical contacts 143 come into elastic contact with the peripheral surface of the substrate W supported on the support surface 135 of the first holding member 110.

The second holding member 112 is opened and closed by a not-shown pneumatic cylinder and by a weight of the second holding member 112 itself. More specifically, the first holding member 110 has a through-hole 110*a*, and a pneumatic cylinder (not shown) is provided in the opposite position of the through-hole 110*a*. The second holding member 112 is opened by extending a piston rod of the pneumatic cylinder through the through-hole 110*a* to push up the seal holder 114 of the second holding member 112. The second holding member 112 is closed by its own weight when the piston rod is retracted.

The substrate W is plated as follows. The pump 16 is set in motion to circulate the plating solution Q between the inner bath 12 and the overflow bath 14 through the plating solution circulation line 32. Then, the substrate W, held by the substrate holder 6, is placed in a given position in the inner bath 12. The insoluble anode 2 is connected to the positive electrode of the power supply 8 through the anode holder 4, and the substrate W is connected to the negative electrode of the power supply 8 through the substrate holder 6, thereby starting to plate the substrate W. While the substrate W is being plated, the agitating paddle (agitator) 38 reciprocates parallel to the surface of the substrate W to agitate the plating solution Q in the plating bath 1.

When an Sn—Ag alloy plating process is carried out using the insoluble anode 2, Sn ions (and Ag ions) in the plating solution Q are consumed as the plating process progresses, and as a result the concentration of Sn ions in the plating solution Q is gradually lowered.

In the embodiment, the Sn alloy plating apparatus includes an Sn ion concentration analyzer 160 for measuring the concentration of Sn ions in the plating solution Q that is held in the inner bath 12 of the plating bath 1, and a controller 162 for replenishing the plating bath 1 with the Sn replenisher supplied from the Sn dissolving bath 62 when the concentration of Sn ions is equal to or lower than a predetermined threshold value. The Sn ion concentration analyzer 160 measures the concentration of Sn ions in the plating solution Q held in the inner bath 12 of the plating bath 1 and sends the measurement result to the controller 162. If the concentration of Sn ions is equal to or lower than the predetermined threshold value, then the controller 162 opens the on-off valve 83 to supply the highly concentrated Sn replenisher, which is stored in the anode chamber 66, into the overflow bath 14 through the Sn replenisher supply line 82.

The amount of the Sn replenisher supplied to the overflow bath 14 is measured by the flow meter 85. The methanesulfonic acid solution and the pure water is the same amount as the amount of the Sn replenisher discharged from the anode chamber 66 are supplied to the cathode chamber 68 and the anode chamber 66. Thereafter, the electrolysis is started again. During the electrolysis, Sn ions, liquated from the Sn anode 70, are supplied to the electrolyte E in the anode chamber 66, thereby generating a new Sn replenisher again. If the concentration of Sn ions in the plating solution Q in the inner bath 12 is equal to or lower than the predetermined threshold value, then the Sn replenisher is supplied again to the overflow bath 14 through the Sn replenisher supply line 82. In this manner, the concentration of Sn ions in the plating solution used in the Sn—Ag alloy plating process is maintained at a constant level.

In the above embodiment, the concentration of Sn ions in the plating solution is measured by the Sn ion concentration analyzer 160, and if the concentration of Sn ions is equal to or lower than the predetermined threshold value, the Sn replenisher is supplied to the plating solution Q. Instead, the object of the present invention can be achieved without the Sn ion concentration analyzer 160. Specifically, the controller 162 may accumulate a value of a current that flows between the insoluble anode 2 and the substrate W during the plating process, and when the accumulated value of the current reaches a predetermined value, the Sn replenisher may be supplied to the plating solution Q. The controller 162 can maintain the concentration of Sn ions in the plating solution used in the Sn—Ag alloy plating process at a constant level, without monitoring the concentration of Sn ions in the plating solution at all times.

The controller 162 may have a calculating function to calculate the concentration of Sn ions and the concentration of the methanesulfonic acid in the electrolyte E based on the amount of the methanesulfonic acid solution supplied, the amount of the pure water supplied, and the amount of the electrolysis performed in the electrolyte E. The amount of the electrolysis can be determined from the product of the current that has been passed to the Sn anode 70 and a current supply time. The controller 162 controls the concentration of Sn ions and the concentration of the methanesulfonic acid in the electrolyte E based on the concentration value of the Sn ions and the concentration value of the methanesulfonic acid. More specifically, the controller 162 regulates the amounts of the pure water and the methanesulfonic acid solution that are supplied respectively from the pure water supply structure 102 and the methanesulfonic acid solution supply structure 103 into the Sn dissolving bath 62, based on the concentration value of the Sn ions and the concentration value of the methanesulfonic acid.

A methanesulfonic acid concentration analyzer 164 for measuring the concentration of the methanesulfonic acid in the plating solution Q is connected to the inner bath 12. The methanesulfonic acid concentration analyzer 164 is connected to the controller 162, so that the measurement value of the methanesulfonic acid concentration is sent to the controller 162. As described above, when the Sn replenisher is supplied to the plating solution Q in the inner bath 12, the methanesulfonic acid may become so excessive that the concentration of the methanesulfonic acid in the plating solution Q may rise. As the plating process proceeds, the methanesulfonic acid is separated as a free acid from tin methanesulfonate and silver methanesulfonate, resulting in an increase in the concentration of the methanesulfonic acid in the plating solution Q in the inner bath 12. Thus, the controller 162 opens the on-off valve 53 to deliver the plating solution Q through the first plating solution supply line 44 to the electrolyte dialysis bath 42 if the concentration of the methanesulfonic acid that is measured by the methanesulfonic acid concentration analyzer 164 is equal to or higher than a predetermined value (e.g., 250 g/L). The electrolyte dialysis bath 42 removes the methanesulfonic acid from the plating solution Q, which is then returned to the overflow bath 14. In this manner, the controller 162 can adjust the concentration of the methanesulfonic acid as a free acid in the plating solution Q used in the plating process in a range of 60 g/L to 250 g/L, or preferably in a range of 90 g/L to 150 g/L. The plating film is thus prevented from being adversely affected by too high a concentration of the methanesulfonic acid as a free acid, and Sn ions can stably be present in the plating solution Q.

The Sn dissolving bath 62 may be provided with an Sn ion concentration analyzer 159 for measuring the concentration of Sn ions in the electrolyte E that is held in the Sn dissolving bath 62, and a methanesulfonic acid concentration analyzer 163 for measuring the concentration of the methanesulfonic acid in the electrolyte E. The measurement results are sent from these analyzers 159, 163 to the controller 162. Based on the measurement results, the controller 162 controls the concentration of Sn ions and the concentration of the methanesulfonic acid in the electrolyte E. More specifically, the controller 162 regulates the amounts of the pure water and the methanesulfonic acid solution supplied respectively from the pure water supply structure 102 and the methanesulfonic acid solution supply structure 103, based on the measurement values of the concentration of the Sn ions and the concentration of the methanesulfonic acid. The concentration of the Sn ions in the electrolyte E in the anode chamber 66 may preferably be in the range of 200 g/L to 350 g/L. The higher the concentration of the Sn ions in the electrolyte E held in the anode chamber 66, the better the Sn replenisher is, because the amount of the Sn replenisher to be supplied from the anode chamber 66 for adjusting the Sn ions in the plating solution Q to a desired concentration can be smaller, i.e., the amount of the plating solution Q to be discharged through the liquid drain pipe 55 in accordance with the amount of the Sn replenisher can be smaller. However, it has been confirmed from experiment that the saturated concentration of Sn ions that can be dissolved and can stably exist together with methanesulfonic acid ions is 350 g/L. If the concentration of Sn ions is higher than 350 g/L, the Sn Ions may be crystallized and caught by the filter or the concentration of Sn ions in the solution may be lowered abruptly.

Figure 6:
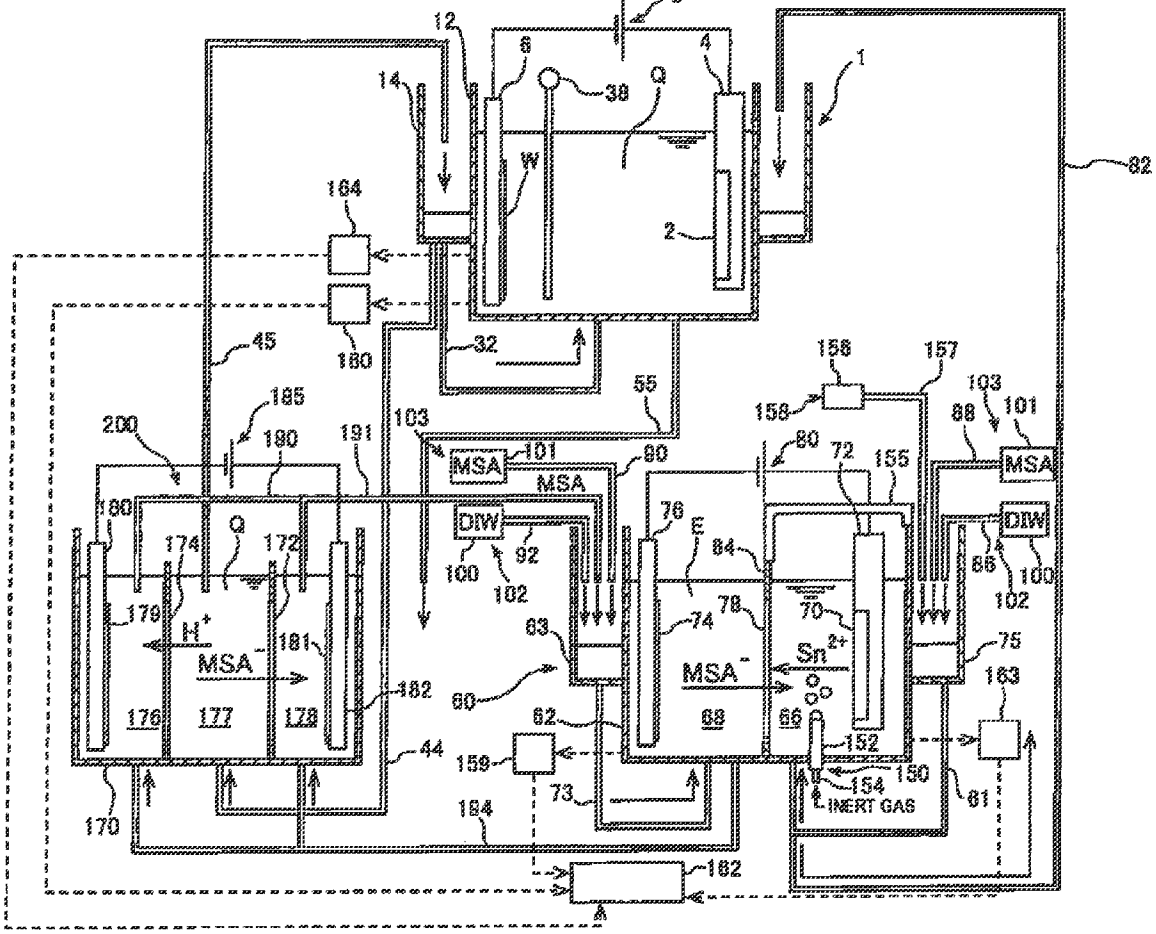
FIG. 6 is a schematic view showing an Sn alloy plating apparatus according to another embodiment.

FIG. 6 is a schematic view showing an Sn alloy plating apparatus according to another embodiment. In FIG. 6, pumps, heat exchangers, filters, flow meters, and on-off valves are omitted from illustration for a better visual understanding. The Sn alloy plating apparatus shown in FIG.

6 is different from the Sn alloy plating apparatus shown in FIG. 1 in that an electric dialysis bath 170 is used instead of the electrolyte dialysis bath 42 for controlling the concentration of the methanesulfonic acid in the plating solution Q.

The electric dialysis bath 170 has an anion exchange membrane 172 and a cation exchange membrane 174 disposed therein. The anion exchange membrane 172 and the cation exchange membrane 174 divide an interior of the electric dialysis bath 170 into a cathode chamber 176, an electric dialysis chamber 177, and an anode chamber 178 which are isolated from each other. The electric dialysis chamber 177 is disposed between the cathode chamber 176 and the anode chamber 178. One end of the first plating solution supply line 44 is connected to the bottom of the overflow bath 14, and the other end is connected to the electric dialysis chamber 177. The plating solution Q in the plating bath 1 is delivered through the overflow bath 14 and the first plating solution supply line 44 to the electric dialysis chamber 177. One end of the second plating solution supply line 45 is connected to the electric dialysis chamber 177, and the other end is connected to an upper portion of the overflow bath 14.

One end of an electrolyte delivery pipe 194 is connected to the bottom of the cathode chamber 68, and the other end is connected to the cathode chamber 176 and the anode chamber 178. The electrolyte E in the cathode chamber 68 is delivered through the electrolyte delivery pipe 194 to the cathode chamber 176 and the anode chamber 178.

A cathode 179 held by a cathode holder 180 is disposed in the cathode chamber 176, and an anode 181 held by an anode holder 182 is disposed in the anode chamber 178. The anode 181 and the cathode 179 are disposed opposite to each other and immersed in the plating solution Q in the electric dialysis bath 170. The anode 181 is coupled to a positive electrode of a power supply 185 through the anode holder 182, and the cathode 179 is coupled to a negative electrode of the power supply 185 through the cathode holder 180. The plating solution Q is delivered from the overflow bath 14 through the first plating solution supply line 44 to the electric dialysis chamber 177. The plating solution Q in the electric dialysis chamber 177 is separated into hydrogen ions ($H^+$) and a methanesulfonic acid ($MSA^-$) by an electrolysis.

The hydrogen ions ($H^+$) move through the cation exchange membrane 174 into the cathode chamber 176, so that a catholyte containing highly concentrated hydrogen ions is produced in the cathode chamber 176. The methanesulfonic acid ($MSA^-$) moves through the anion exchange membrane 172 into the anode chamber 178, so that an anolyte containing a highly concentrated methanesulfonic acid is produced in the anode chamber 178. The catholyte containing the highly concentrated hydrogen ions and the anolyte containing the highly concentrated methanesulfonic acid flow as a methanesulfonic acid replenisher through delivery pipes 190, 191 into the cathode-side overflow bath 63 of the Sn dissolving device 60. The electric dialysis bath 170 and the delivery pipes 190, 191 jointly constitute a methanesulfonic acid supplementing structure 200. The methanesulfonic acid supplementing structure 200 thus constructed is effective to reduce an amount of a methanesulfonic acid that is supplied from the methanesulfonic acid solution supply structure 103 to the cathode chamber 68.

During the electrolysis as discussed above, the methanesulfonic acid is removed from the plating solution Q in the electric dialysis chamber 177, and then the plating solution Q is returned to the overflow bath 14 through the second plating solution supply line 45. The plating solution Q that has been returned to the overflow bath 14 is supplied to the inner bath 12 for use in plating of the substrate W again.

Figure 7:
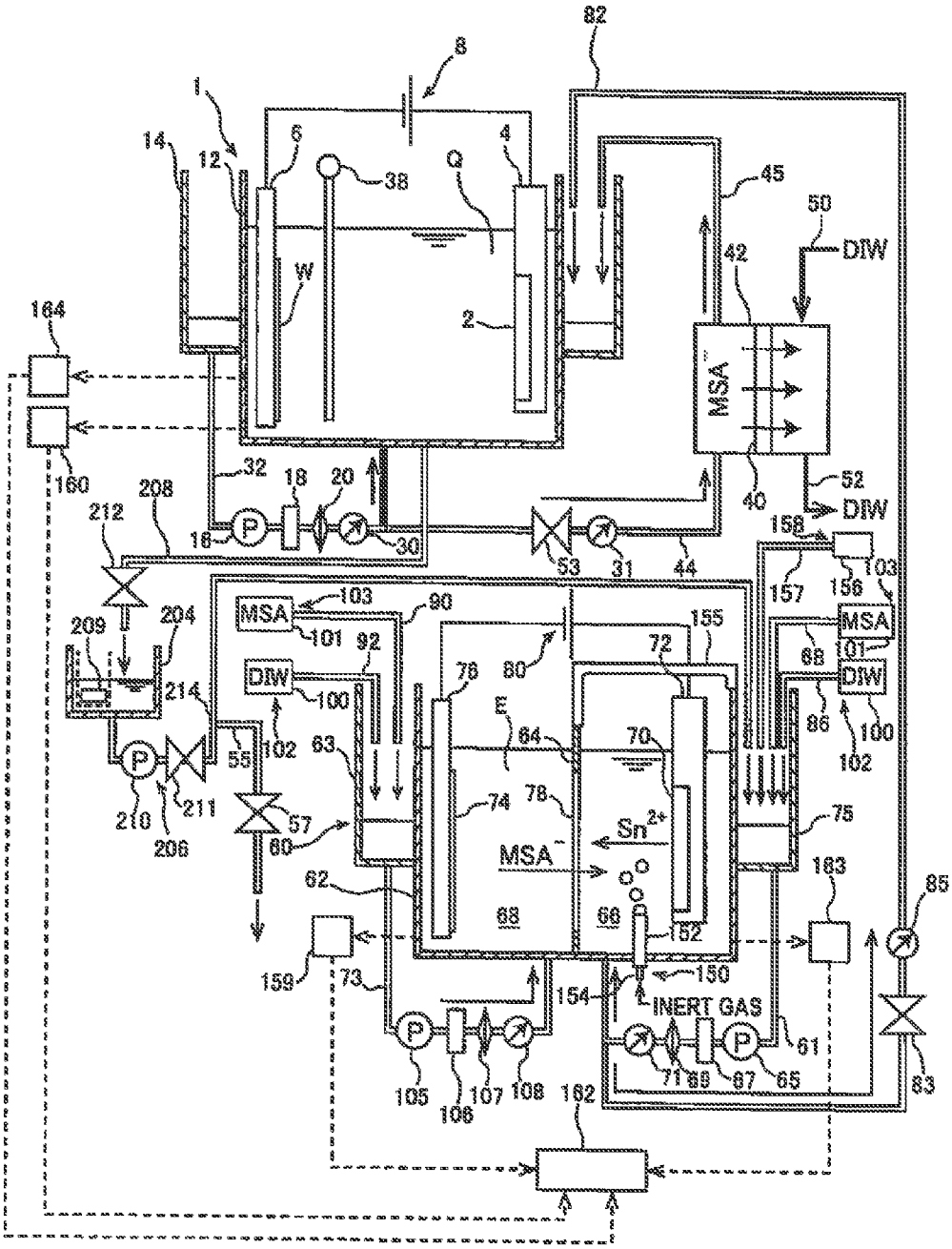
FIG. 7 is a schematic view showing an Sn alloy plating apparatus according to still another embodiment.

FIG. 7 is a schematic view showing an Sn alloy plating apparatus according to still another embodiment. When the concentration of Sn ions in the plating solution Q held in the plating bath 1 is equal to or lower than the predetermined threshold value, the Sn replenisher is supplied from the Sn dissolving bath 62 into the overflow bath 14. In this case, it is necessary to discharge from the plating bath 1 approximately the same amount of the plating solution Q as the amount of the Sn replenisher to be supplied into the plating bath 1 and thereafter to supply the highly concentrated Sn replenisher to the plating bath 1. However, the discharged plating solution Q contains a large amount of Sn ions although the concentration of Sn ions therein is not more than the predetermined threshold value. In order to reuse the discharged plating solution Q, the Sn alloy plating apparatus in this embodiment has a plating solution reservoir 204 for storing the discharged plating solution Q therein and a plating solution delivery structure 206 for supplying the plating solution Q in the plating solution reservoir 204 through the anode-side overflow bath 75 to the anode chamber 66.

One end of a first plating solution delivery line 208 for delivering the plating solution Q to the plating solution reservoir 204 is connected to the bottom of the inner bath 12, and the other end is connected to the plating solution reservoir 204. The first plating solution delivery line 208 is provided with an on-off valve 212.

The plating solution delivery structure 206 includes a second plating solution delivery line 214 extending from the plating solution reservoir 204 to the anode-side overflow bath 75, a pump 210 for delivering the plating solution in the second plating solution delivery line 214, and an on-off valve 211 attached to the second plating solution delivery line 214. The liquid drain pipe 55 with the on-off valve 57 attached thereto is coupled to the second plating solution delivery line 214, so that any excessive plating solution Q is discharged through the liquid drain pipe 55.

As the Sn replenisher is supplied to the plating bath 1, the amount of the electrolyte E in the anode chamber 66 is reduced. On the other hand, since the plating solution Q, discharged from the plating bath 1, is returned to the anode chamber 66 through the plating solution reservoir 204 and the plating solution delivery structure 206, the Sn ions in the plating solution Q can effectively be reused.

According to the present embodiment, the plating solution Q that contains Ag ions is discharged from the plating bath 1 and supplied to the anode chamber 66. During this operation, Ag may be deposited as a result of a substitution reaction on the surface of the Sn anode 70, and eventually the deposited Ag may fall off. Therefore, it is desirable to surround the anode holder 72, holding the Sn anode 70, with an anode beg.

An Sn metal body 209 may be placed in the plating solution reservoir 204 so as to be immersed in the plating solution Q. The Sn metal body 209 may be made of Sn itself or may be made of any base material coated with Sn, so long as the Sn metal body 209 has an exposed Sn metal surface. The Ag ions in the plating solution Q are deposited as a result of a substitution reaction on the surface of the Sn metal body 209 disposed in the plating solution reservoir 204, and are hence caught or recovered before the Ag ions are introduced into the anode chamber 66. Consequently, a reduced amount of Ag ions is introduced into the anode chamber 66, resulting in less deposition on the surface of the Sn anode 70. Therefore, the Sn anode 70 can be used for a long period of time. The decrease in Ag ions, consumed by the deposition as a result of a substitution reaction on the surface of the Sn metal body 209, is replenished by supply of a silver methanesulfonate solution into the plating solution Q. This replenishment of the Ag ions is carried out in ordinary plating processes, and involves no extra costs. Rather, a large cost reduction is expected because the Sn ions to be discarded otherwise can effectively be reused.

The Sn metal body 209 is detachably held by a holder, not shown, so that it can be removed from the plating solution reservoir 204 after it has caught a sufficient amount of Ag ions and a new Sn metal body can be introduced. In order to prevent the deposited Ag from falling into the plating solution Q, the holder is surrounded by a bag which is made of the same material as the anode bag.

Figure 8:
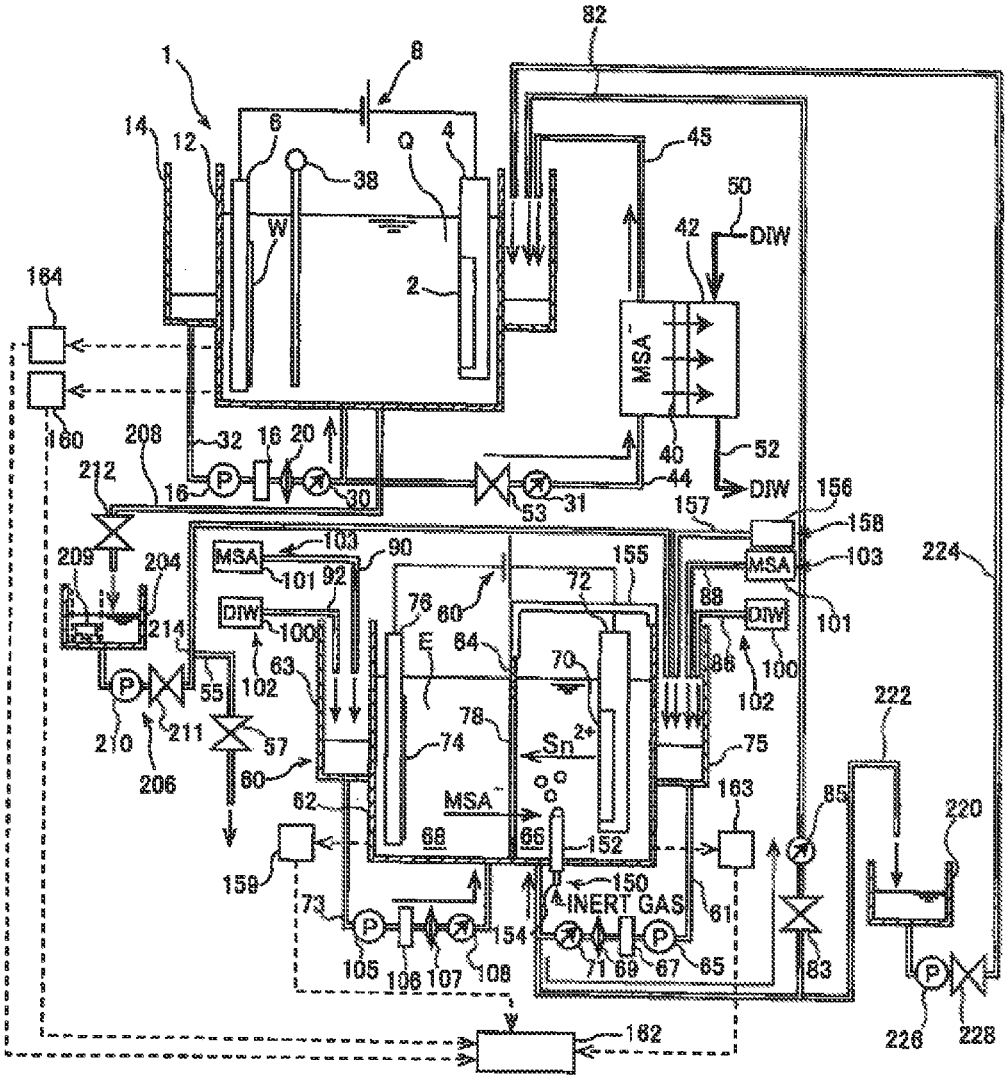
FIG. 8 is a schematic view showing an Sn alloy plating apparatus according to still another embodiment.

FIG. 8 is a schematic view showing an Sn alloy plating apparatus according to yet another embodiment. When the concentration of Sn ions in the plating solution Q in the plating bath 1 is equal to or lower than the predetermined threshold value, the Sn replenisher is supplied from the Sn dissolving bath 62 to the overflow bath 14. If a large amount of the Sn replenisher is required, the electrolyte E stored in the anode chamber 66 of the Sn dissolving bath 62 may not be enough. To prepare for a large amount of the Sn replenisher which may be required, the Sn alloy plating apparatus in this embodiment has an Sn replenisher reservoir 220 for temporarily storing the Sn replenisher produced in the Sn dissolving bath 62.

The Sn replenisher produced in the Sn dissolving bath 62 by the electrolysis is delivered to the Sn replenisher reservoir 220 and stored therein. The pure water and the methanesulfonic acid solution are supplied into the anode chamber 66 and the electrolysis is performed to produce a highly concentrated Sn replenisher again. In case a large amount of the Sn replenisher is required, the Sn replenisher in the anode chamber 66 as well as the Sn replenisher in the Sn replenisher reservoir 220 may be supplied to the plating bath 1. One end of a first Sn replenisher delivery line 222 is connected to the Sn replenisher supply line 82 upstream of the on-off valve 83, and the other end is connected to the Sn replenisher reservoir 220. A second Sn replenisher delivery line 224 is connected to the bottom of the Sn replenisher reservoir 220 and extends to the overflow bath 14. A pump 226 and an on-off valve 228 for delivering the Sn replenisher are attached to the second Sn replenisher delivery line 224. A part of the Sn replenisher flowing in the Sn replenisher supply line 12 is introduced through the first Sn replenisher delivery line 222 into the Sn replenisher reservoir 220. When necessary, the Sn replenisher stored in the Sn replenisher reservoir 220 is supplied through the second Sn replenisher delivery line 224 to the overflow bath 14. According to the present embodiment, an Sn replenisher supply structure for supplying the Sn replenisher produced in the Sn dissolving bath 62 is constructed by the pump 65, the Sn replenisher supply line 82, the on-off valve 83, the first Sn replenisher delivery line 222, the second Sn replenisher delivery line 224, the Sn replenisher reservoir 220, the pump 226, and the on-off valve 228.

As with the anode chamber 66, the Sn replenisher reservoir 220 may have an inert gas bubbling device and a cover for covering the surface of the Sn replenisher in order to prevent the oxidation of the Sn ions contained in the Sn replenisher.

Figure 9:
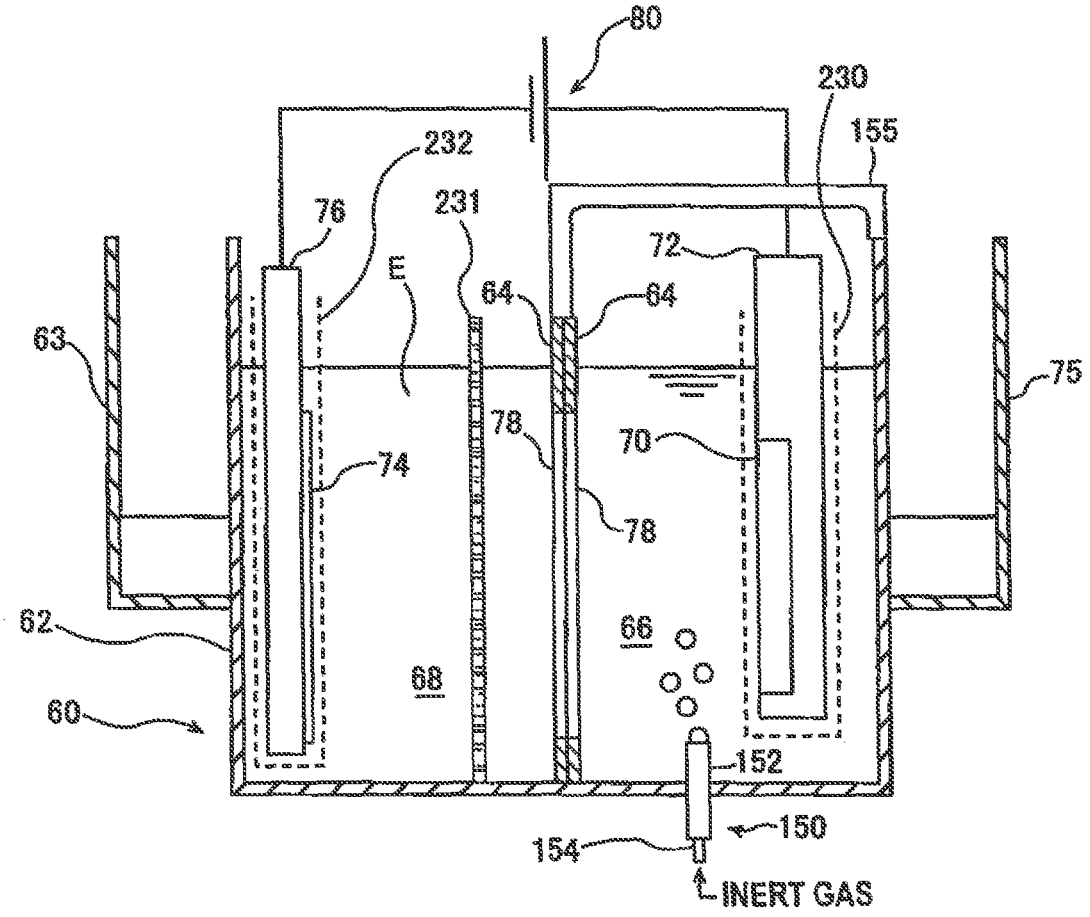
FIG. 9 is view showing an anode bag and a basket disposed in an Sn dissolving bath.

As the electrolysis proceeds, a black film is deposited on the surface of the Sn anode 70 disposed in the anode chamber 66. When the black film (deposited material) grows, it may fall off the Sn anode 70. In addition, when the plating solution Q stored in the plating solution reservoir 204 is supplied to the Sn dissolving bath 62, the Sn anode 70 may produce sludge. In order to capture by-products, such as the deposited material and the sludge, it is preferable to install an anode bag 230 surrounding the anode holder 72, as shown in FIG. 9. The anode bag 230 captures the by-products, such as the deposited material and the sludge, and can therefore prevent the by-products from being scattered or falling off in the Sn dissolving bath 62. As a result, the filter 69, which is used for preventing the particle contamination of the Sn replenisher and for circulating the Sn replenisher, can have a longer service life.

If the anion exchange membrane 78 is broken or there is a gap between the anion exchange membrane 78 and the partition wall 64, the solution in the anode chamber 66 and the solution in the cathode chamber 68 may possibly be exchanged with each other. Thus, at least two superposed anion exchange membranes 78 are preferably disposed in the Sn dissolving bath 62, as shown in FIG. 9. Even if one of the anion exchange membranes 78 is broken or defective, the other anion exchange membrane 78 can prevent compounds other than anions from being exchanged. In particular, when metal cation moves into the cathode chamber 68, the cation may be deposited and solidified on the surface of the cathode 74. This issue can be avoided by using at least two superposed anion exchange membranes 78.

As the electrolysis proceeds, a deposited material grows on the surface of the cathode 74 and may eventually reach the anion exchange membrane 78. As the deposited material further grows, it may penetrate the anion exchange membrane 78. If a portion of the deposited material enters the anode chamber 66, the Sn ions in the anode chamber 66 concentrate on the deposited material, and Sn is deposited thereon, resulting in a significant reduction in the concentration of Sn ions in the anode chamber 66. To avoid this, it is preferable to install a basket 232 made of resin and surrounding the cathode holder 76, as shown in FIG. 9. Even if a deposited material grows on the surface of the cathode 74, the basket 232 can prevent the deposited material from contacting the anion exchange membrane 78. Instead of or in addition to the basket 232, a microporous membrane 231 having micropores (e.g., Yumicron membrane (registered trademark)) or an anion exchange membrane, in addition to the anion exchange membrane 78, may be disposed between the cathode 74 and the anion exchange membrane 78. These membranes are effective to prevent the deposited material from contacting the anion exchange membrane 78 as with the basket 232.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims and equivalents.

What is claimed is:

1. A Sn alloy plating apparatus for plating a surface of a substrate with an alloy of Sn and a metal nobler than Sn, comprising: a plating bath configured to store a Sn alloy plating solution therein with an insoluble anode and a substrate disposed opposite to each other in the Sn alloy plating solution;

a Sn dissolving bath having a Sn anode and a cathode arranged opposite to each other in an electrolyte, the Sn dissolving bath having an anion exchange membrane therein which isolates an anode chamber, in which the Sn anode is disposed, and a cathode chamber, in which the cathode is disposed, from each other;

pure water supply lines coupled to the anode chamber and the cathode chamber;

a methanesulfonic acid solution supply structure having a methanesulfonic acid solution supply tank and methanesulfonic acid solution supply lines coupled to the anode chamber and the cathode chamber, the methanesulfonic acid solution supply structure supplying a methanesulfonic acid solution, containing a methanesulfonic acid for stabilizing Sn ions, to the anode chamber and the cathode chamber;

a Sn replenisher supply line that couples the anode chamber to the plating bath to deliver a Sn replenisher, produced in the anode chamber and containing Sn ions and a methanesulfonic acid, to the plating bath;

an electric dialysis bath to electrolyze the plating solution to produce a methanesulfonic acid replenisher containing a methanesulfonic acid and remove methanesulfonic acid from the plating solution;

a delivery pipe to deliver the methanesulfonic acid replenisher to the Sn dissolving bath; and a plating solution supply line that couples the electric dialysis bath to the plating bath to deliver the plating solution, from which the methanesulfonic acid has been removed, to the plating bath.

2. The Sn alloy plating apparatus according to claim 1, further comprising:

a gas supply structure configured to supply an inert gas into the Sn replenisher produced in the anode chamber.

3. The Sn alloy plating apparatus according to claim 1, further comprising:

a plating solution reservoir configured to store the plating solution discharged from the plating bath.

4. The Sn alloy plating apparatus according to claim 3, further comprising:

a plating solution delivery line that couples the plating solution reservoir to the anode chamber.

5. The Sn alloy plating apparatus according to claim 1, further comprising:

an anode bag surrounding the Sn anode.

6. The Sn alloy plating apparatus according to claim 1, wherein the anion exchange membrane comprises at least two superposed anion exchange membranes.

7. The Sn alloy plating apparatus according to claim 1, further comprising:

a microporous membrane having micropores which is disposed between the anion exchange membrane and the cathode.

8. The Sn alloy plating apparatus according to claim 1, wherein the cathode is made of platinum, titanium, zirconium, or titanium or tin covered with platinum.

9. The Sn alloy plating apparatus according to claim 1, further comprising a Sn replenisher reservoir configured to store the Sn replenisher produced in the anode chamber.

10. The Sn alloy plating apparatus according to claim 1, further comprising: a Sn ion concentration analyzer configured to measure a concentration of Sn ions in the electrolyte in the anode chamber; a methanesulfonic acid concentration analyzer configured to measure a concentration of a methanesulfonic acid in the electrolyte in the anode chamber; and a controller configured to control the concentration of Sn ions and the concentration of the methanesulfonic acid in the electrolyte in the anode chamber, wherein the controller is configured to regulate amounts of the pure water and the methanesulfonic acid solution which are supplied respectively from the pure water supply lines and the methanesulfonic acid solution supply line to the Sn dissolving bath, based on measurement values of the concentration of the Sn ions and the concentration of the methanesulfonic acid.

11. An Sn alloy plating apparatus according to claim 1, further comprising:

a controller having a calculating function to calculate a concentration of the Sn ions and a concentration of the methanesulfonic acid in the electrolyte based on an amount of the methanesulfonic acid solution supplied, an amount of the pure water supplied, and an amount of electrolysis performed in the electrolyte in the Sn dissolving bath, wherein the controller is configured to regulate the amounts of the pure water and the methanesulfonic acid solution which are supplied respectively from the pure water supply structure and the methanesulfonic acid solution supply structure to the Sn dissolving bath, based on the concentration of the Sn ions and the concentration of the methanesulfonic acid.

* * * * *